United States Patent [19]

Bates

[11] 4,087,881

[45] May 9, 1978

[54] CARPET CLEANING MACHINE

[76] Inventor: Jack A. Bates, 2530 Fishinger, Columbus, Ohio 43221

[21] Appl. No.: 665,269

[22] Filed: Mar. 9, 1976

[51] Int. Cl.[2] ..... A47L 9/00

[52] U.S. Cl. ..... 15/300 A; 15/321; 15/353

[58] Field of Search ..... 15/300 A, 320, 321, 15/353

[56] References Cited

U.S. PATENT DOCUMENTS

| | | | |
|---|---|---|---|
| 3,262,146 | 7/1966 | Hays | 15/321 |
| 3,552,100 | 1/1971 | Ekenberg | 15/353 X |
| 3,705,437 | 12/1972 | Rukavina, Jr. et al. | 15/314 X |
| 3,747,155 | 7/1973 | Koellisch | 15/321 X |
| 3,774,260 | 11/1973 | Emus, Jr. | 15/321 |
| 3,818,537 | 6/1974 | Evans | 15/321 |
| 3,828,390 | 8/1974 | Cater | 15/321 |
| 3,974,541 | 8/1976 | Silvis et al. | 15/300 A X |

FOREIGN PATENT DOCUMENTS

| | | | |
|---|---|---|---|
| 2,328,941 | 1/1975 | Germany | 15/321 |

*Primary Examiner*—Christopher K. Moore

[57] ABSTRACT

A carpet cleaning machine wherein cleaning fluid is continuously dispensed to an in-place carpet from manually manipulatble tools and wherein dirty fluid is continuously picked up from the carpet and conveyed to a dirty fluid collecting means. The machine is characterized by a plurality of individually operated tools connected to a common machine frame and common operating components mounted therein thereby providing for the simultaneous work efforts of a plurality of tool operators.

8 Claims, 7 Drawing Figures

CARPET CLEANING MACHINE

BACKGROUND OF THE INVENTION

This invention relates generally to carpet cleaning machines for in-place carpets and more particularly to such an apparatus which is adapted to continuously dispense cleaning fluid to and pick up dirty solution from the carpets.

SUMMARY OF THE INVENTION

In general, the present invention comprises a carpet cleaning machine of relatively high capacity wherein a plurality of working tools for dispensing and picking up cleaning fluid are all operated from a single frame means utilizing common machine components.

More particularly, each of the cleaning tools is adapted for individual control by a respective operator and moreover each tool is provided with suction control means for automatically terminating dirty fluid pick up from the carpet upon filling of the dirty water collecting chamber thereby precluding dirty fluid carryover to the machine's suction system.

As another aspect of the present invention the machine is adapted to supply cleaning fluid in the form of heated water and soap solution from a common source operated by a single power source that also operates the other functions of the machine.

As another aspect of the present invention the carpet cleaning machine is adapted to meter controlled amounts of soap solution to a continuously delivered supply of heated cleaning water.

It is, therefore, an object of the present invention to provide a carpet cleaning machine that includes a novel arrangement for operating a multiplicity of individual cleaning fluid applicator tools which are operated from common components driven by a central power source.

It is another object of the present invention to provide a carpet cleaning machine of the type described wherein the vacuum applied at each of the tools is individually and automatically controlled so as to protect the vacuum system of the machine.

It is another object of the present invention to provide a novel multiple tool carpet cleaning machine adapted for the controlled metering of soap solution to heated cleaning water as the latter is continuously delivered to the tools.

It is another object of the present invention to provide a carpet cleaning machine of the type described which includes a holding tank for a heated solution of cleaning fluid and water which tank is provided with an automatically controlled valve means for maintaining a supply of mixed hot water and soap solution with such valve being responsive to the demand imposed by the release of fluid from one or more of the cleaning tools.

It is another object of the present invention to provide an apparatus of the type described wherein the holding tank means automatically maintains a supply of heated cleaning solution when the machine is transferred from one job to another such that the machine is ready for immediate use.

It is still another object of the present invention to provide a carpet cleaning machine of the type described which includes a built-in loading belt means and removable leg apparatus which provides means for easy loading and unloading of the machine on a truck bed.

Further objects and advantages of the present invention will be apparent from the following description, reference being had to the accompanying drawings wherein preferred forms of embodiments of the invention are clearly shown.

DESCRIPTION OF THE PREFERRED EMBODIMENT

Referring in detail to the drawings, the carpet cleaning machine constructed in accordance with the present invention is illustrated in FIGS. 1–4 and includes a frame means indicated generally at 20. The frame means serves to mount all of the components of the machine which in general function to deliver cleaning solution to a plurality of carpet cleaning tools indicated generally at 22 and 24 with such components also serving to pick up the dirty cleaning fluid extracted from a carpet 26 by the tools 22 and 24.

Figure 4:
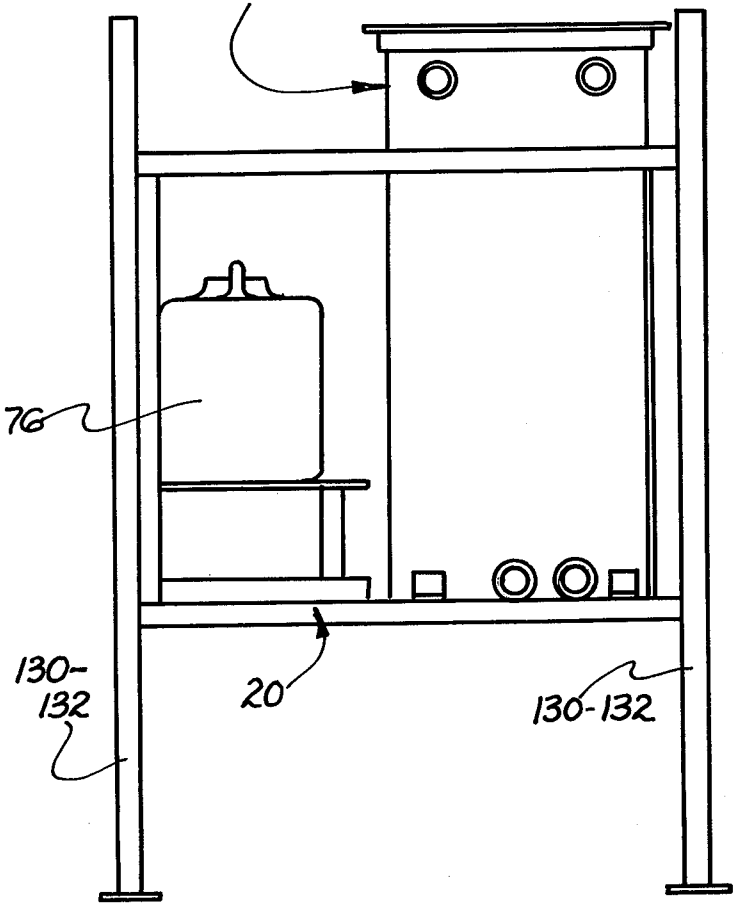
FIG. 4 is a rear elevational view of the machine of FIG. 1.
Figure 3:
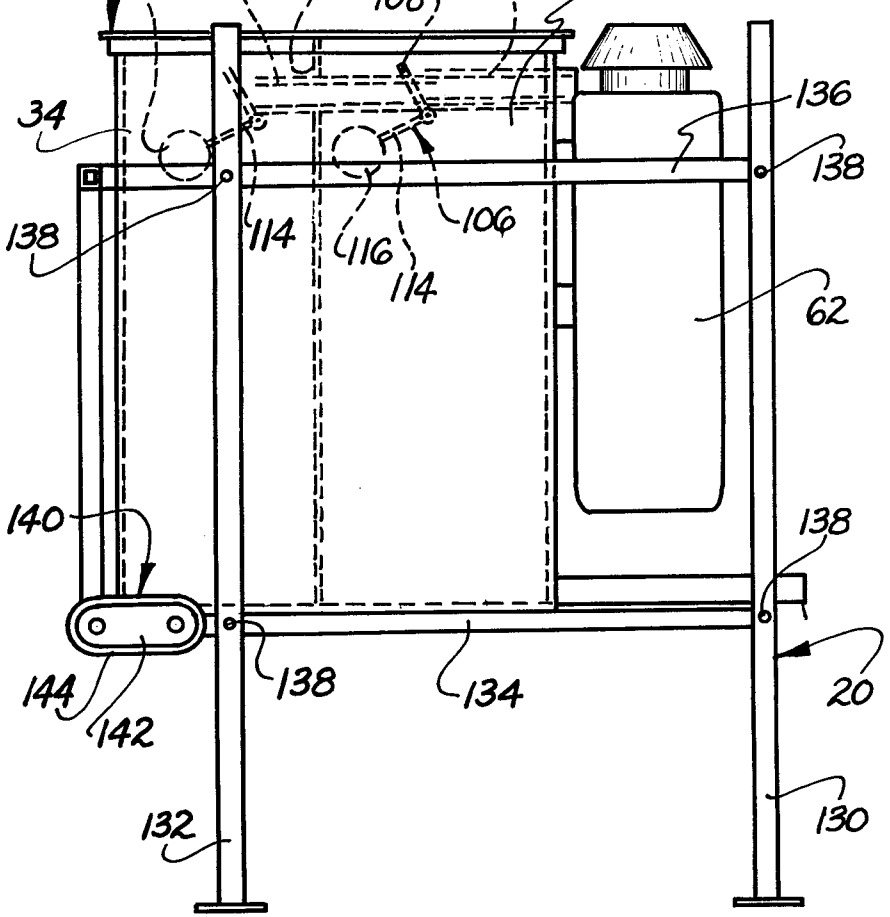
FIG. 3 is a left side elevational view of the machine of FIG. 1.

As is best seen in FIGS. 3 and 4, the frame means supports a dirty fluid collecting means indicated generally at 30 which consists of a double chamber tank that includes a dividing wall 32 that forms the separate chambers 34 and 36.

Each of the chambers 34 and 36 is connected to a respective one of the vacuum pumps 38 and 40 by vacuum lines 42 and 44 with the vacuum pump being vented to the atmosphere by an exhaust line 46 that includes a muffler 48.

Figure 2:
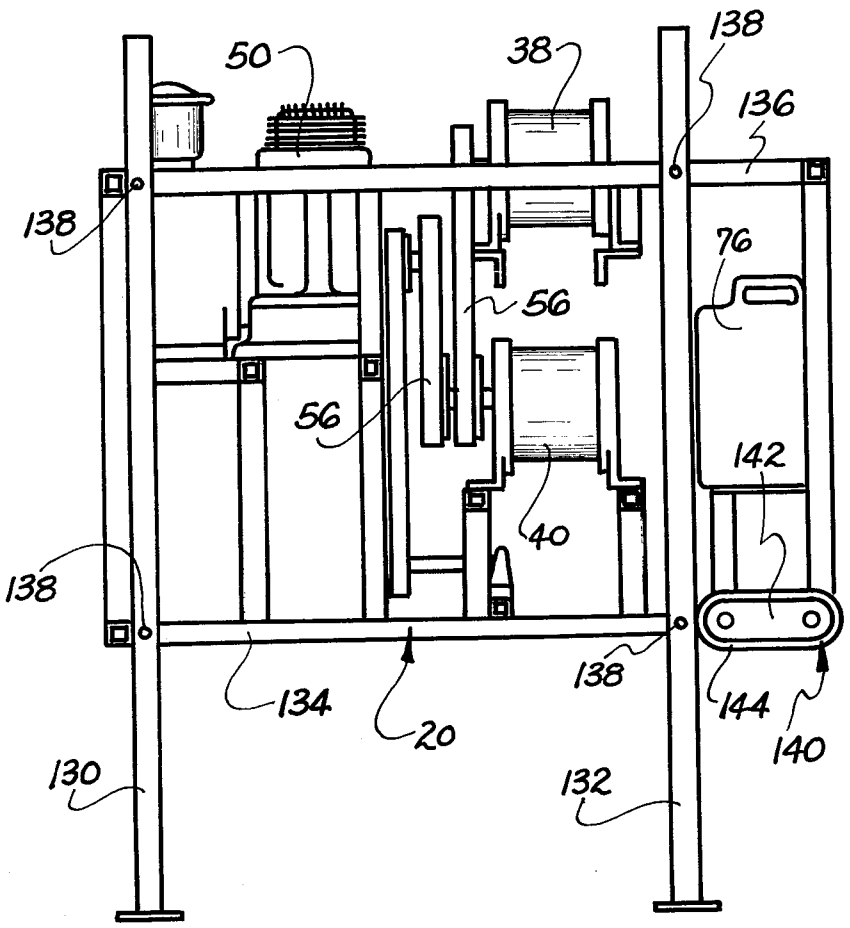
FIG. 2 is a right side elevational view of the machine of FIG. 1.
Figure 5:
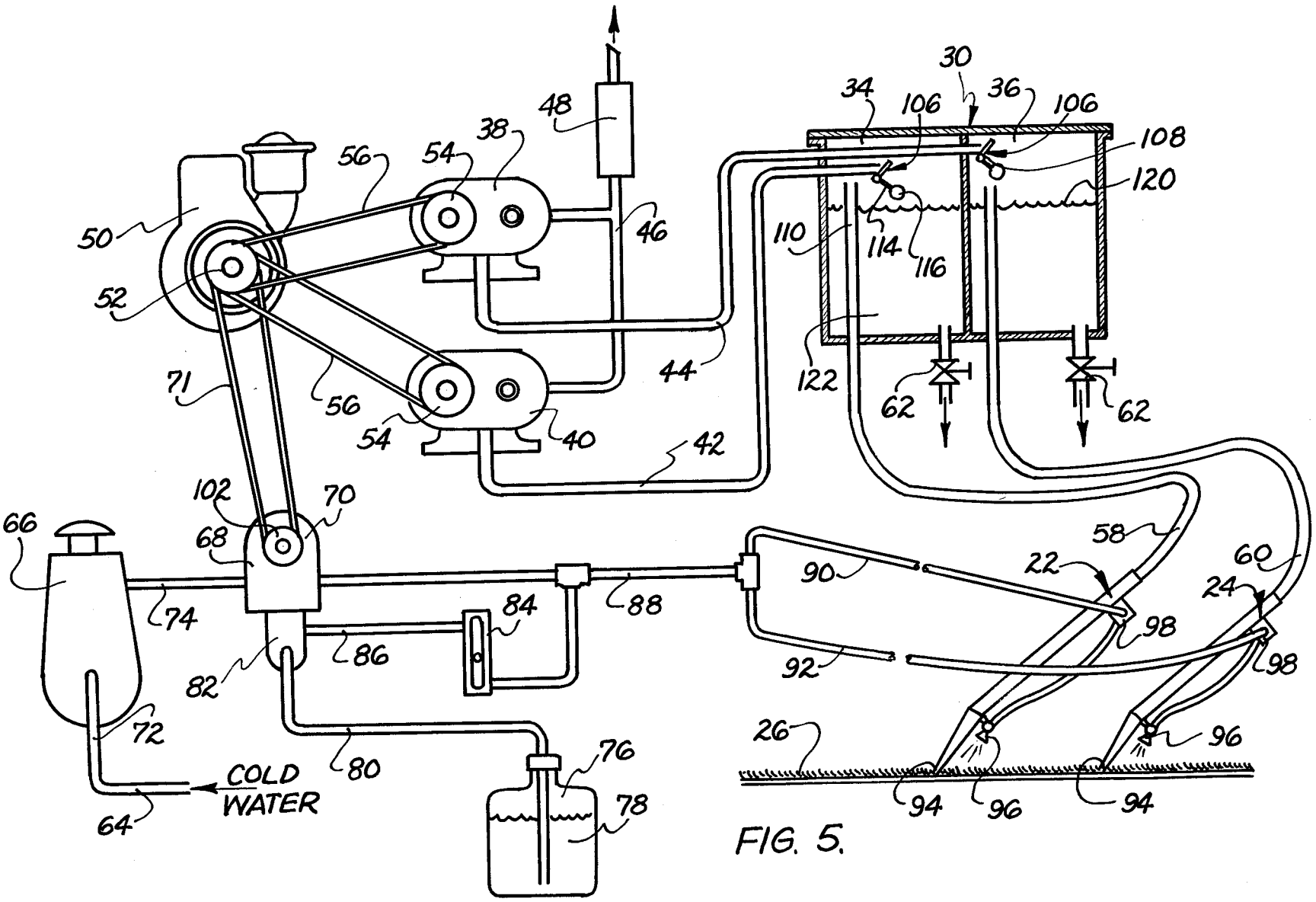
FIG. 5 is a diagrammatic view showing the fluid flow system of the machine of the preceding figures.

With reference to FIGS. 2 and 5, vacuum pumps 38 and 40 are driven by a gasoline engine 50 via the driving pulley 52, driven pulleys 54, and V-belts 56.

The vacuum water pick up system further includes the flexible lines 58 and 60 which connect the tools 22 and 24 to the dirty fluid chambers 34 and 36.

It should be mentioned that chambers 34 and 36 are provided with manually operated drain valves 62.

Reference is next made to the cleaning fluid supply system wherein cold water is picked up via line 64 and delivered through a water heater 66 to the inlet 68 of a primary water pump 70 with the lines 72 and 74 serving to connect the heater with the walls and the inlet of the pump.

The cleaning fluid system further includes a container or cleaning fluid reservoir 76 of soap solution 78 which is delivered via line 80 to a secondary solution pump 82 and thence to a flow meter and control 84.

A line 86 delivers the soap solution from the secondary pump to the flow meter and thence to the previously mentioned tools 22 and 24 via the lines 88, 90, and 92.

With reference to FIG. 5, each of the tools 22 and 24 includes a dirty fluid inlet 94 and a cleaning solution outlet 96 and a shut-off valve 98 is mounted on each of the tools between outlets 96 and flexible lines 90 and 92.

It should be mentioned that secondary solution pump 82 is gear driven by primary water pump 68 with the latter being driven by engine 50 with belt 71 connecting pulley 102 to one of the engine pulleys 52.

As seen in FIG. 5, each of the tools 22 and 24 is provided with a suction breaking device indicated generally at 106 which includes a flap 108 which is pivotally mounted to a suction line inlet 110 at the hinge pivot 112.

Flap 108 is rigidly connected to an arm 114 with a float 116 being mounted on the end of the arm such that when the surface level 120 in the dirty fluid bath 122 rises to a certain level float 116 rises with the fluid level and moves flap 108 towards suction line inlet 110. When flap 128 reaches a certain position, then it is snapped closed and retained in that position by the suction present in line 42 or 44.

Referring particularly to FIGS. 2 and 3, frame means 20 is provided with detachable legs 130–132 with such legs being removable from the transverse frame members 134 and 136 by detaching the fasteners 138.

With continued reference to FIGS. 2 and 3, frame means 20 further includes a pair of roll-on loading means indicated generally at 140 with such loading means including a roller supporting frame 142 which carries an endless belt 144.

It should be pointed out that the roll-on loading means 140 are mounted on the transverse frame members 134 at the rear portion of the frame and in a position outboard of the rear legs 132. With this arrangement, the two loading means can be positioned over the bed of a truck by backing the truck into a position wherein the bed underlies the loading means 140. With the front end of the machine being held up, the legs 130 and 132 can be quickly removed by detaching fasteners 138 and the frame of the machine can then easily be loaded completely onto the truck bed for transportation to the job site. It will be understood that the machine can be removed from the truck bed by reversing the above procedures.

Figure 1:
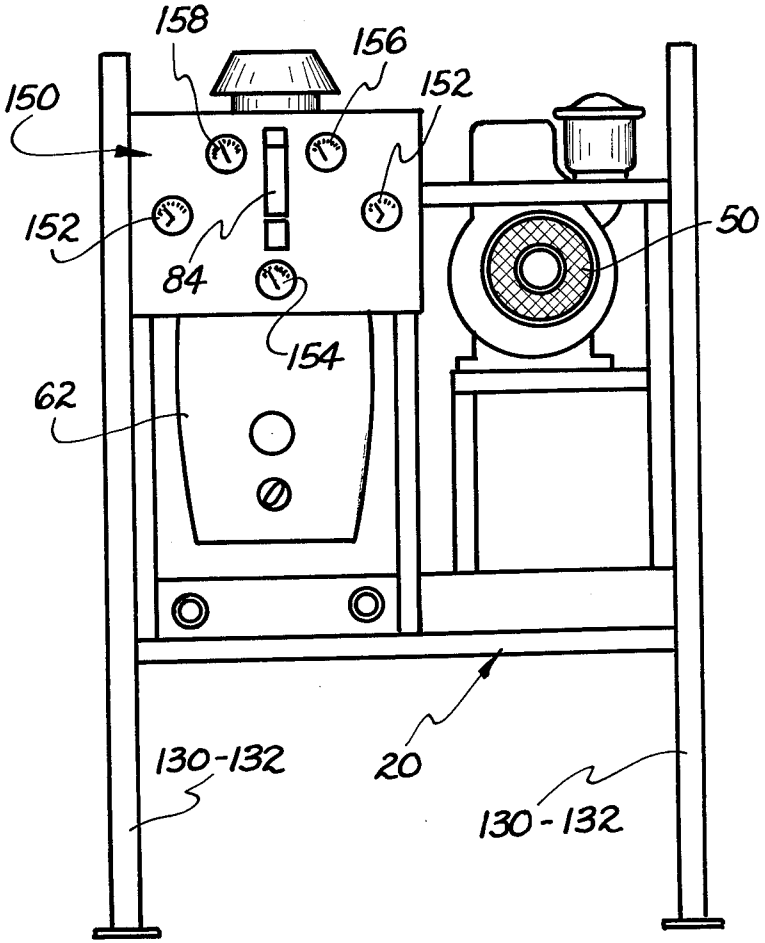
FIG. 1 is a front elevational view of a carpet cleaning machine constructed in accordance with the present invention.

With reference to FIG. 1, a control panel 150 is provided on the front of the machine and includes vacuum gauges 152 for the vacuum system, a water temperature gauge 154, as well as the previously mentioned flow meter and control 84. Control panel 150 further includes an engine tachometer 156 and a time meter 158.

In operation, the engine 50 is started to institute operation of vacuum pumps 38 and 40 as well as the primary and secondary solution pumps 70 and 82. The water heater is also turned on thereby providing warm pressurized water in the flexible lines 90 and 92 as well as vacuum in the flexible pick up lines 58 and 60.

Each of the tools is then manipulated by a separate operator so as to move the inlets 94 across carpet 26, and, at the same time, valves 98 are opened to permit the delivery of heated cleaning solution, including the soap solution 78, to the carpet.

The tools are moved back and forth across the carpet to pick up the dirty cleaning solution which is delivered via the lines 58 and 60 to the respective dirty fluid collecting chambers 34 and 36. When the fluid level 120 in either of the chambers 34 or 36 rises to the level of fluid 116, then the fluid moves upwardly as the chamber fills to a point where the suction snaps closed the flap 108 thereby automatically terminating vacuum effect at the tool operating with the particular tank that has filled.

It should be pointed out that when flap 108 closes inlet 110, then the respective suction line 42 or 44 is closed thereby preventing either of the pumps 38 or 40 from receiving flow of the dirty fluid.

Figure 6:
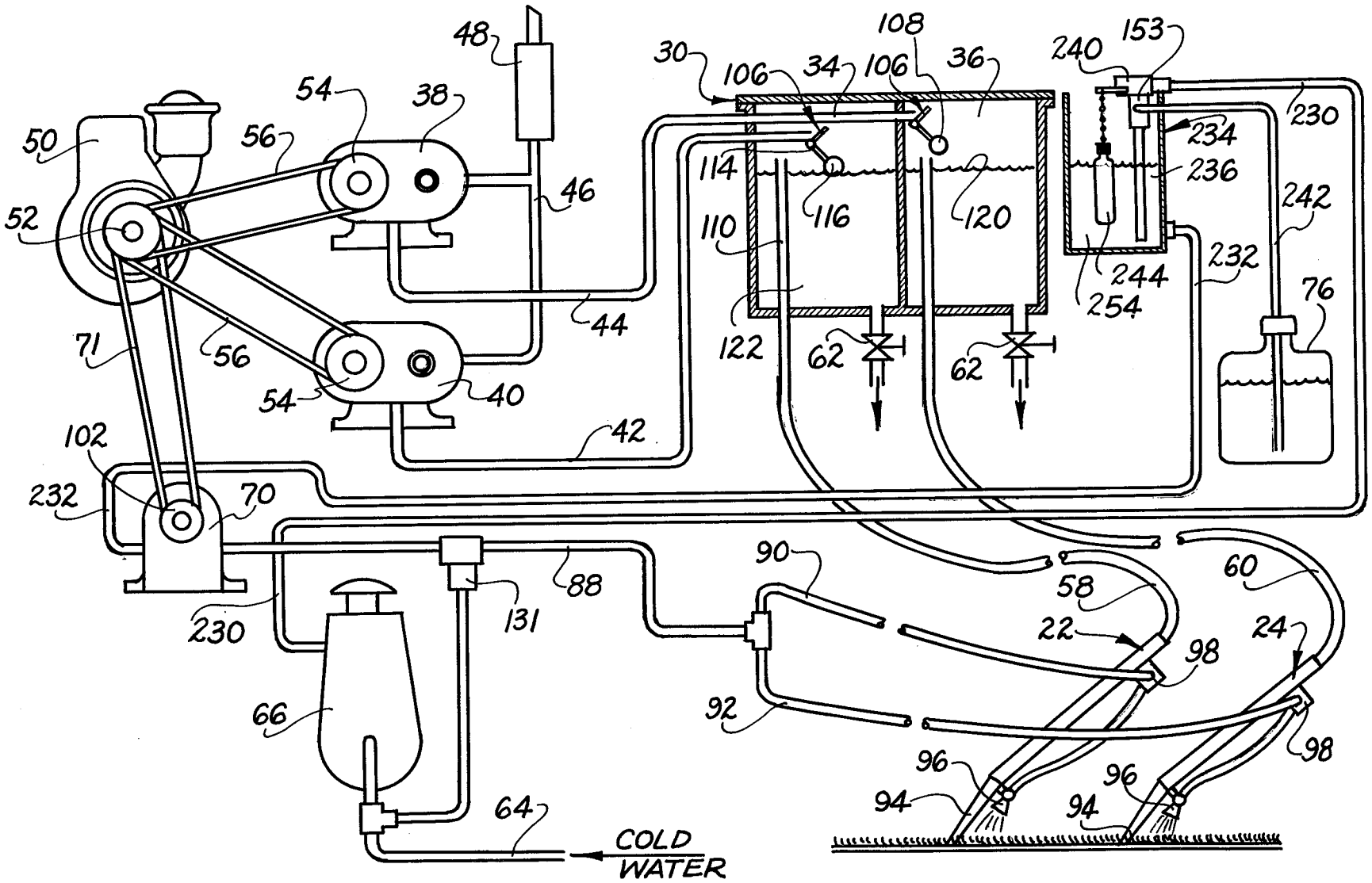
FIG. 6 is a second diagrammatic view showing a modified fluid flow system constructed in accordance with the present invention.
Figure 7:
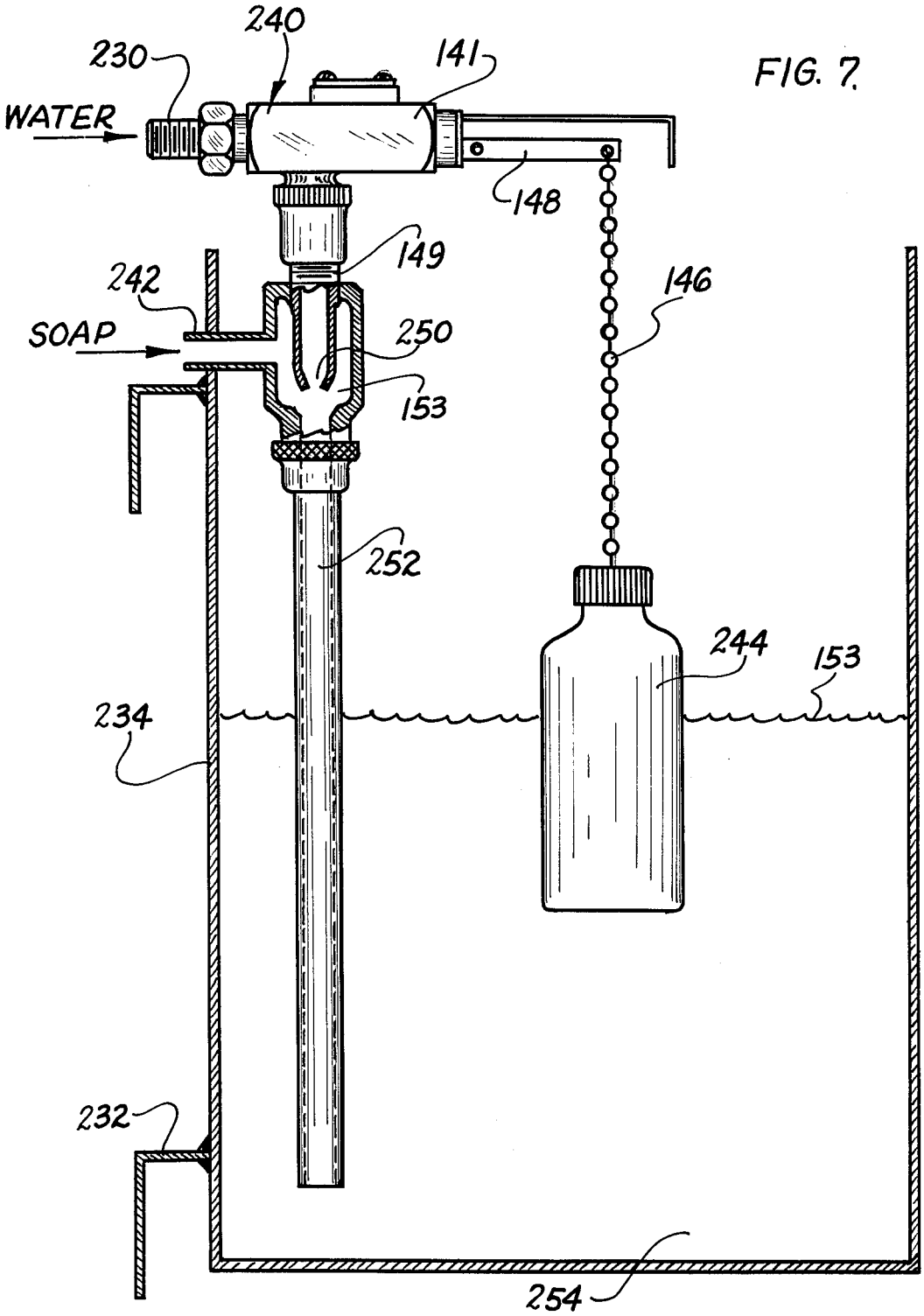
FIG. 7 is a side sectional view of a holding tank and venturi valve comprising a portion of the modified system of FIG. 6.

Reference is next made to FIGS. 6 and 7 which show a a modified flow system wherein elements identical to those of the system of FIG. 5 are designated by identical numerals.

The system of FIGS. 6 and 7 differ from that of FIG. 5 primarily in that it includes a holding tank indicated generally at 134 for a heated solution of cleaning fluid and water.

Cold water from a pressurized supply such as a household tap passes via line 64 to the inlet of a hot water heater 66 and then through line 230 to the water inlet of an on-off valve 240.

FIG. 6 is an enlarged view of holding tank 234 showing valve 240 which includes a housing 141 that encloses a snap action on-off valve for connecting the inlet line 230 with the tube 149 that includes a venturi orifice 250.

As seen in FIG. 6, the valving elements in housing 141, which include a seat and movable enclosure, not illustrated, are actuated by an arm 148 that is connected to a float 244 by a chain 146. When the solution level 153 in holding tank 234 rises to a pre-selected level, then float 244 releases valve arm 148 for upward movement with said arm being biased upwardly by an internal spring. Upon upward movement of arm 148 then the hot water control valve 240 is closed.

Upon operation of the tools 22 and/or 24, heated solution is delivered to the tool outlets 94 and 96 via line 230, pump 70, and lines 88 and 90 and manual shut-off valve 28. It should be mentioned that the outlet of pump 70 is provided with a pressure release valve 131 which drops back to cold water inlet line 64 thereby protecting the system from excessive pressure build up.

It should be mentioned that the system of FIGS. 6 and 7 further includes a cleaning fluid reservoir 76 which is connected to an annular chamber 153 via soap delivery line 242 such that upon the discharge of pressurized water from vent orifice 250 a suction is created in chamber 153 and line 242 which draws cleaning fluid from reservoir 76 and adds it to the incoming water from line 230 thereby providing a heated solution of cleaning fluid and water in the outlet line 252 leading from the outlet of the venturi chamber.

While the form of embodiment of the present invention as herein disclosed constitutes a preferred form, it is to be understood that other forms might be adopted.

What is claimed is:

1. A carpet cleaning machine comprising, in combination, a frame; a dirty fluid collecting means mounted on said frame and including first and second collecting chambers, each of said chambers including a collecting chamber inlet and a collecting chamber outlet; a cleaning fluid reservoir mounted on said frame and including a reservoir outlet; first and second vacuum pumps mounted on said frame, each of said pumps including a pump inlet connected to a respective one of said collecting chamber outlets; water heater means mounted on said frame and including a cold water inlet and a hot water outlet; first and second manually manipulatable carpet cleaning tools, each of said tools including a tool outlet for dispensing a mixture of water and cleaning fluid on a carpet and a tool inlet for collecting dirty fluid from the carpet; first and second flexible dirty fluid conduits, each of said conduits connecting a respective one of said tool inlets with a respective dirty fluid collecting chamber; first and second vacuum cut-off means for terminating the suction at a respective tool inlet, each of said cut-off means being associated with a respective dirty fluid collecting chamber, said vacuum cut-off means being automatically operative responsive to dirty fluid rising to a predetermined fluid level in a respective dirty fluid collecting chamber; holding tank means for holding a heated solution of cleaning fluid and water mounted on said frame and including a holding tank inlet and a holding tank outlet; valve means for controlling a flow of cleaning fluid and hot water to said holding tank means inlet; an automatic valve actuator for said valve means for shifting said valve means between "open" and "closed" positions responsive to the rising of the solution to a predetermined level in said holding tank means; pump means including a pump inlet communicating with said holding tank outlet and a pump outlet; first and second flexible cleaning fluid conduits, each of said conduits connecting a respective one of said tool outlets with said outlet of said pump means; and power means mounted on said frame for driving said pump means and blower means.

2. The carpet cleaning machine defined in claim 1 wherein each of said vacuum cut-off means comprises a normally open closure for a respective one of said collecting chamber outlets, and a float disposed in said chamber and connected to said closure for moving said closure towards a closed position.

3. The carpet cleaning machine defined in claim 1 wherein said valve means comprises a venturi restriction in said hot water inlet for drawing said cleaning fluid from said cleaning fluid reservoir responsive to flow of the hot water through said venturi.

4. The carpet cleaning machine defined in claim 1 wherein said automatic valve actuator includes a float disposed in the liquid in said holding tank means.

5. The carpet cleaning machine defined in claim 1 wherein each of said vacuum cut-off means comprises a normally open closure for a respective one of said collecting chamber outlets, and a float disposed in said chamber and connected to said closure for moving said closure towards a closed position; and wherein said valve means comprises a venturi restriction in said hot water inlet for drawing said cleaning fluid from said cleaning fluid reservoir responsive to flow of the hot water through said venturi.

6. The carpet cleaning machine defined in claim 1 wherein each of said vacuum cut-off means comprises a normally open closure for a respective one of said collecting chamber outlets, and a float disposed in said chamber and connected to said closure for moving said closure towards a closed position; and wherein said valve means comprises a venturi restriction in said hot water inlet for drawing said cleaning fluid from said cleaning fluid reservoir responsive to flow of the hot water through said venturi; and wherein said automatic valve actuator includes a float disposed in the liquid in said holding tank means.

7. The carpet cleaning machine defined in claim 1 wherein said frame includes a frame bottom; a loading belt mounted on said frame at said frame bottom and extending outwardly therefrom; leg means removably mounted on said frame for holding said frame bottom at a certain level above the ground at which level the loading belt can overlie the bed of a truck onto which the machine is to be loaded such that the loading belt and frame bottom can be rolled onto the truck bed when said leg means are removed.

8. A carpet cleaning machine comprising, in combination, a frame including a frame bottom; dirty fluid collecting means mounted on said frame; cleaning solution dispensing means mounted on said frame; a cleaning tool including a cleaning solution outlet and a dirty fluid collecting inlet; conduit means connecting said tool inlet with said collecting means and said tool outlet with said cleaning solution dispensing means; water heater means mounted on said frame for supplying hot water to said cleaning solution dispensing means; power means mounted on said frame for driving said collecting means; a loading belt mounted on said frame at said frame bottom and extending outwardly therefrom; leg means removably mounted on said frame for holding said frame bottom at a certain level above the ground at which level the loading belt can overlie the bed of a truck onto which the machine is to be loaded such that the loading belt and frame bottom can be rolled onto the truck bed when said leg means are removed.

* * * * *